US007581799B2

(12) United States Patent
Im et al.

(10) Patent No.: US 7,581,799 B2
(45) Date of Patent: Sep. 1, 2009

(54) APPARATUS AND METHOD FOR PRINTING ACCORDING TO THE TYPE OF PRINT MEDIA USING A PRINTER HAVING WIDE PRINTHEAD

(75) Inventors: Dae-hyeok Im, Suwon-si (KR); Young-bok Ju, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 367 days.

(21) Appl. No.: 11/171,363

(22) Filed: Jul. 1, 2005

(65) Prior Publication Data

US 2006/0001693 A1 Jan. 5, 2006

(30) Foreign Application Priority Data

Jul. 5, 2004 (KR) ..... 10-2004-0051980

(51) Int. Cl.
*B41J 29/38* (2006.01)

(52) U.S. Cl. ..... 347/14; 347/19; 347/101

(58) Field of Classification Search ..... 347/14, 347/15, 19, 101, 105, 16
See application file for complete search history.

(56) References Cited

U.S. PATENT DOCUMENTS 5,469,199 A 11/1995 Allen et al.
5,870,117 A * 2/1999 Moore ..... 347/37
5,923,348 A * 7/1999 Cunnagin et al. ..... 347/42
6,325,505 B1 12/2001 Walker
6,359,701 B1 * 3/2002 Yamada et al. ..... 358/1.2
6,398,333 B1 * 6/2002 Mulay et al. ..... 347/14
6,443,555 B1 9/2002 Silverbrook et al.
6,672,706 B2 1/2004 Silverbrook
6,775,022 B2 * 8/2004 Noyes et al. ..... 358/1.15
6,984,034 B2 * 1/2006 Tsujimoto ..... 347/105

FOREIGN PATENT DOCUMENTS

| | | |
|---|---|---|
| JP | 09-234903 | 9/1997 |
| JP | 2000-043328 | 2/2000 |
| JP | 2001-088275 | 4/2001 |
| JP | 2001-301144 | 10/2001 |
| KR | 1998-067424 | 10/1998 |
| KR | 2001-0009062 | 2/2001 |
| KR | 2003-0014853 | 2/2003 |
| KR | 10-2004-0022008 | 3/2004 |

* cited by examiner

*Primary Examiner*—Thinh H Nguyen
(74) *Attorney, Agent, or Firm*—Roylance, Abrams, Berdo & Goodman, LLP

(57) ABSTRACT

An apparatus and method for printing according to the type of print media when a printer having a wide printhead is used for printing is disclosed. The method comprises picking up the print medium and feeding the medium toward under the wide printhead; determining a type of the fed medium; and printing the medium in a predetermined resolution and in a predetermined ink dropping speed according to the type of the medium. Therefore, an optimal printing quality corresponding to the type of used paper can be obtained even when a user does not set the resolution.

5 Claims, 3 Drawing Sheets

APPARATUS AND METHOD FOR PRINTING ACCORDING TO THE TYPE OF PRINT MEDIA USING A PRINTER HAVING WIDE PRINTHEAD

CROSS-REFERENCE TO RELATED APPLICATION

This application claims the benefit under 35 U.S.C. §119 (a) of Korean Patent Application No. 10-2004-0051980, filed on Jul. 5, 2004, in the Korean Intellectual Property Office, the entire disclosure of which is hereby incorporated by reference.

BACKGROUND OF THE INVENTION

1. Field of the Invention

The present invention relates to a printing method for obtaining an optimal vertical resolution according to the type of print media used when a printing process is performed on a print media using a printer having a wide printhead covering a width of the print media.

2. Description of the Related Art

In general, a printhead that discharges ink droplets of a predetermined color on a print medium is disposed at a bottom of an ink cartridge of an inkjet printer. For performing a printing process on a print medium, the medium is fed in a sub-scan direction sequentially while the ink cartridge is moved in a main scan direction. The ink cartridge should be moved slowly in the main scan direction for performing the printing of high resolution.

U.S. Pat. No. 5,469,199 discloses a wide printhead, nozzles of which are disposed longer than a width of a print medium. When a high resolution image is printed using the wide printhead, the printing speed in the main scan direction can be improved, and since the ink is dropped from the printhead in a suspended state, a precise printing operation can be performed.

There are various types of print media that can be used in the inkjet printer having the wide printhead, for example, plain paper, paper exclusively for inkjet printer, photo paper, and transparencies. The each type of the media has an appropriate resolution thereof, for example, the appropriate resolution for the paper exclusively for inkjet printers is 600 dpi, and the appropriate resolution for photo paper is 1200 dpi. For transparencies, it is important to control ink dropping speed in order to prevent the ink from spreading.

Particularly, since the printer having the wide printhead is mainly used in a printing operation for high quality, if a user uses the plain paper together with the specialized media such as the paper exclusively for inkjet, the photo paper, and the transparent paper, the user may deal with the specialized paper as though it is plain paper without recognizing the resolution appropriate for the specialized paper and the printing quality may be degraded.

SUMMARY OF THE INVENTION

The present invention provides an apparatus and method for printing according to the type of print media when a printer having a wide printhead is used.

According to an aspect of the present invention, there is provided a printing method for printing according to a type of print media used with an inkjet printer, which includes a wide printhead having a width longer than a width of the print media and is disposed perpendicular to the media conveying direction, the method comprising the steps of picking up the print medium and feeding the medium under the wide printhead; determining the type of the medium being fed; and printing on the medium in a predetermined resolution and at a predetermined ink dropping speed according to the type of the medium.

The determining of the type of the medium may be performed by inputting the type of the medium that will be fed using a control panel or a host computer that provides printing data by a user.

The determining of the type of the medium may comprise the steps of detecting a characteristic value of the fed medium; and determining the type of the medium by comparing a characteristic value of the medium to values stored in a look-up table.

The characteristic value may be an optical output value that is measured by an optical sensor by irradiating light onto the fed medium and receiving the light reflected from the medium.

When printing on the medium, a vertical resolution may be formed by controlling a feeding speed of the medium using a feeding roller driver, and a horizontal resolution and an ink dropping speed may be controlled by using a printhead driver that controls the nozzles of the printhead.

An exemplary embodiment of the invention comprises a printer controller for controlling the printing of an image on a medium, a sensor for detecting a characteristic of a print medium on which an image is to be printed; a look-up table for storing characteristics of different types of print media, a feeding roller driver for controlling the vertical resolution of the image to be printed on the print medium, and a printhead driver for controlling the horizontal resolution of the image to be printed on the print medium.

BRIEF DESCRIPTION OF THE DRAWINGS

The above and other features and advantages of the present invention will become more apparent by describing in detail exemplary embodiments thereof with reference to the attached drawings in which.

Throughout the drawings, it should be understood that like reference numerals refer to like features, structures, and elements.

DETAILED DESCRIPTION OF EXEMPLARY EMBODIMENTS

Exemplary embodiments of the present invention will now be described more fully with reference to the accompanying drawings.

Figure 1:
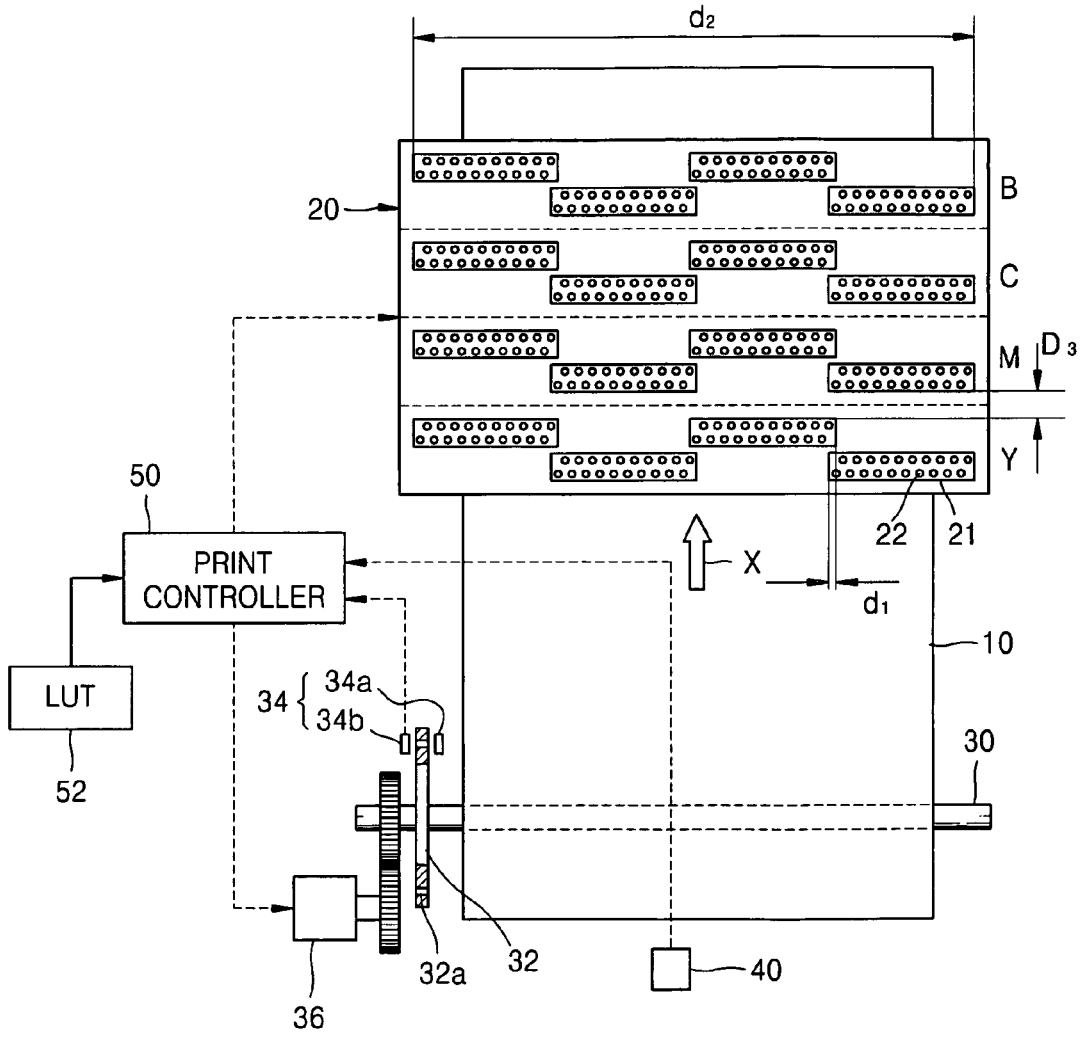
FIG. 1 is a schematic plan view showing an inkjet printer having a wide printhead, which is applied in a method for printing according to the type of print media according to an embodiment of the present invention.

FIG. 1 is a schematic plan view showing a structure of an inkjet printer having a wide printhead, which is used in a method for printing based on the type of print media according to an embodiment of the present invention.

Referring to FIG. 1, in the inkjet printer, a wide printhead 20, a feeding roller 30, and an optical sensor 40 are sequentially disposed in a paper conveying direction, that is, the direction represented by arrow X. The speed at which the thermal paper 10 enters under the wide printhead 20 is controlled by an operation of the feeding roller 30.

A plurality of nozzle plates 21, through which yellow (Y), magenta (M), cyan (C), and black (K) color inks are respectively discharged, are disposed at a bottom of the wide printhead 20. The four nozzle plates 21 of each of four colors are overlapped with each other perpendicularly to the paper conveying direction (sub-scan direction) represented by the arrow X. In a case where the effective lengths of the nozzle plates 21 are 2.1 inches respectively and the length ($d_1$) in which they are overlapped is 0.1 inch, an effective length ($d_2$) of the printhead 20 is 8.1 inches in a main scan direction. Therefore, the print medium, typically, paper, 10 having an effective printing width of 8.1 inches or less, for example, A4 sized paper can be printed on using the inkjet printer.

On the each nozzle plate 21, nozzles 22, through which inks are dropped, are disposed in two rows in zigzag or offset formations. The nozzles 22 may be disposed in a row, two rows or more.

A predetermined distance ($d_3$) is formed between the nozzle plates 21 of the respective colors, and wires (not shown) for applying signals to the nozzles 22 are disposed on the distance ($d_3$).

An encoder disk wheel 32 is installed on an outer circumference of the feeding roller 30. Slits 32*a* are formed on an edge of the encoder disc wheel 32 at predetermined locations, and rotary encoder sensors 34 including a light emitting portion 34*a* and a light receiving portion 34*b* are mounted on both sides of the slit 32*a*. The light emitting unit 34*a* of the rotary encoder sensor 34 emits light at predetermined intervals, and the light receiving unit 34*b* generates pulse signals whenever it receives light emitted by the light emitting unit 34*a* through the slit 32*a*. A print controller 50 counts the pulse signals to measure a conveyed distance that the medium 10 is transported by the feeding roller 30, and drives a driving motor 36 to control the distance the medium 10 is transported by the feeding roller 30. Reference numeral 52 denotes a look-up table (LUT).

The optical sensor 40 is disposed in front of the feeding roller 30. The paper is transported in the direction shown by the arrow X, during which light is emitted onto the paper 10 as it is transported under the sensor 40, which receives the light reflected from the paper 10. The Optical sensor 40 transmits the received optical output to the print controller 50. The print controller 50 determines the type of paper 10 by comparing the transmitted optical output to optical output values of respective paper types stored in the LUT 52.

Figure 2:
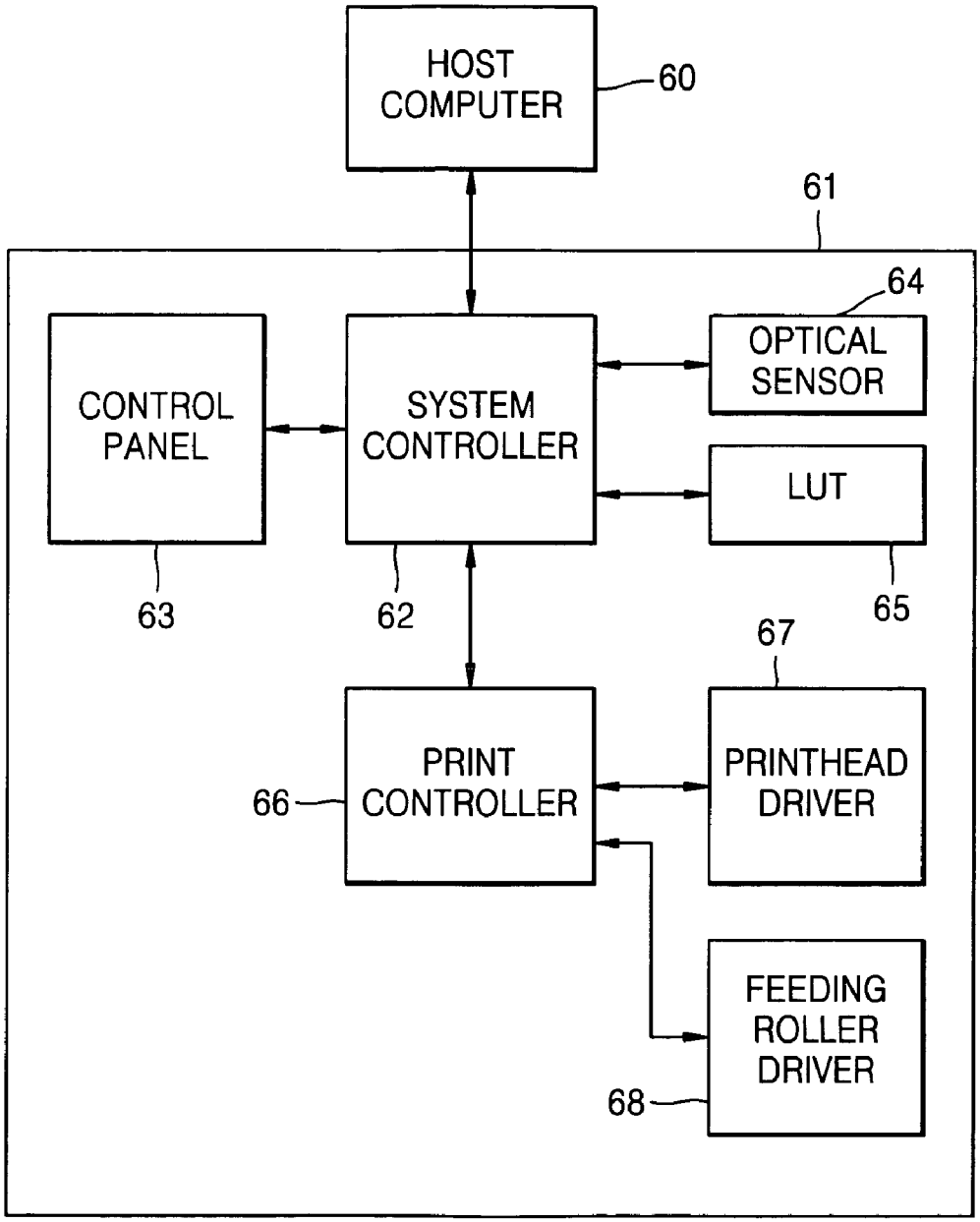
FIG. 2 is a block diagram illustrating a structure of a print control system adopted in the printing method according to an embodiment of the present invention.

FIG. 2 is a block diagram illustrating a structure of a print control system that implements the printing method of an embodiment of the present invention.

Referring to FIG. 2, the print control system comprises a host computer 60 and a printer apparatus 61. The printer apparatus 61 comprises a system controller 62, a control panel 63, a sensor 64, an LUT 65, a print controller 66, a printhead driver 67, and a feeding roller driver 68.

The host computer 60 transmits print data that is generated by a printer driver (not shown) thereof to the printer apparatus 61.

In the printer apparatus 61, the system controller 62 controls the overall operation of the printer apparatus 61, and preferably includes a central processing unit (CPU) of a microprocessor form, a read only memory (ROM) for storing fixed data such as a control program, and a read access memory (RAM) for storing operating data of the system controller 62. The system controller 62 determines the type of the paper that is fed into the printer by comparing a characteristic value of the paper, for example, the optical output value, to the optical output values stored in the LUT 65 for different types of print media.

The control panel 63 includes a key matrix (not shown) and a display unit (not shown). The key matrix generates data according to the keys pushed by the user for designating a print mode and operating the designated mode, and outputs the generated data to the system controller 62. The display unit displays the operation status of the printer apparatus 61 when the system controller 62 performs the print modes.

The print controller 66 generates control data corresponding to the type of print media determined by the system controller 62, and controls the printhead driver 67 and the feeding roller driver 68 according to the control data to form an image on the paper 10 in a predetermined resolution.

The printing method according to an embodiment of the present invention will now be described with reference to FIG. 3.

Figure 3:
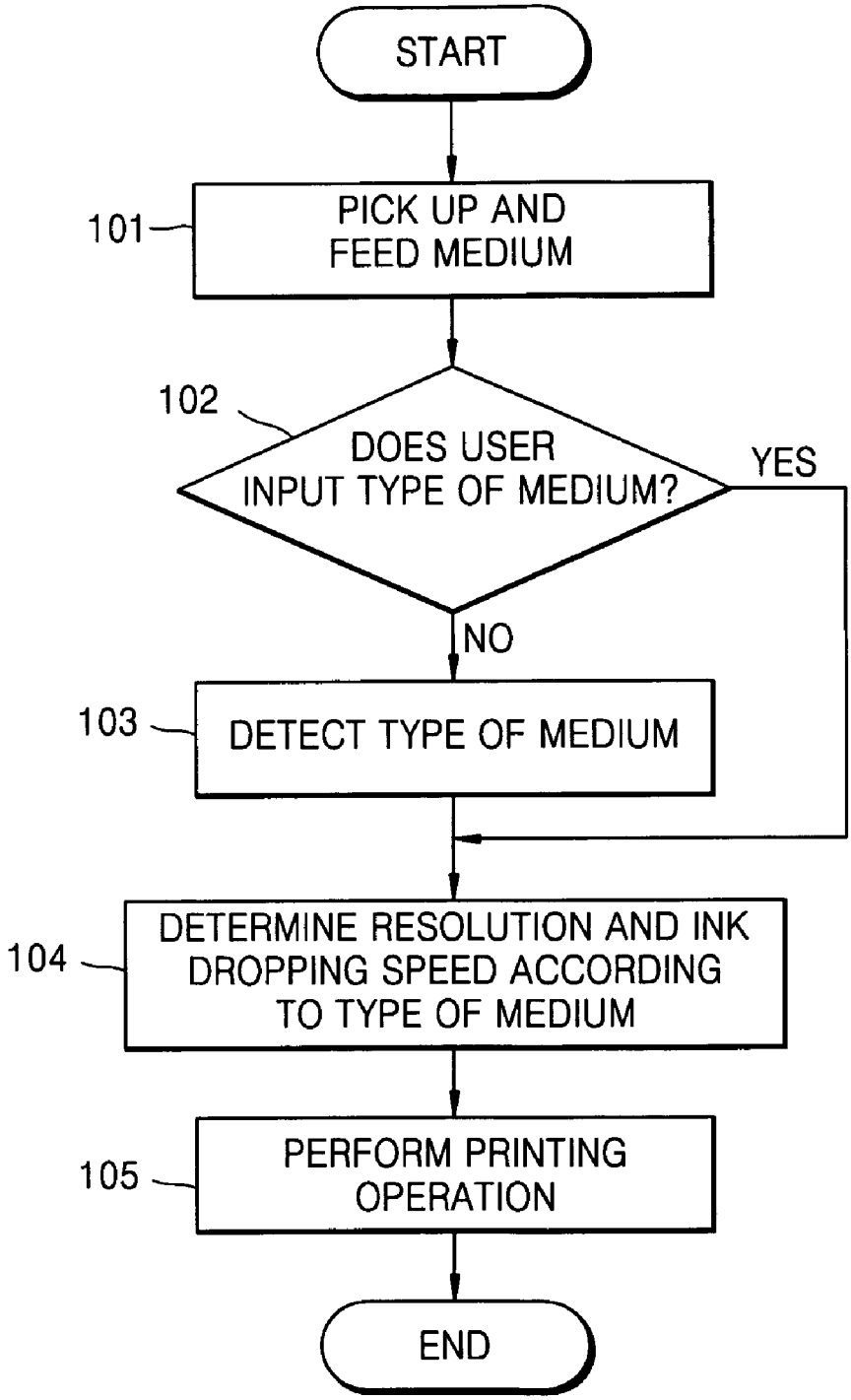
FIG. 3 is a flow chart illustrating the printing method according to an embodiment of the present invention.

FIG. 3 is a flow chart illustrating the printing method according to an embodiment of the present invention.

When a command for printing is input into the print controller 66 from the host computer 60 connected to the inkjet printer 61, a sheet of paper 10 is picked up by a pickup roller (not shown) and fed under the wide printhead 20 (S101).

In addition, it is determined whether the user has input the type of paper (S102). If it is determined that the user inputs the paper type using the control panel 63 or the host computer 60 that provides the print data in step S102, step S104 is performed.

Alternatively, if it is determined that the user has not input the type of paper in S102, the type of paper is measured by a media sensor installed in the printer 61, for example, the optical sensor 64. The optical sensor 64 emits light onto the paper 10, measures the light reflected from the paper 10, and outputs the optical output value to the print controller 66. The print controller 66 determines the type of paper 10 by comparing the input optical output to the optical output values of respective paper types previously stored in the LUT 65 (S103).

In addition, the print controller 66 extracts an appropriate resolution and ink dropping speed according to the type of paper from the LUT 65 (S104).

Then the print controller 66 controls the feeding roller driver 68 according to the resolution and the ink dropping speed to form a vertical resolution in a sub-scan direction, and controls the printhead driver 67 that controls the nozzles 22 of the printhead 20 to form a horizontal resolution in a main scan direction, and controls the ink dropping speed to perform the printing operation (S105).

According to the printing method according to the media types using the printer having the wide printhead of the present invention, an optimal printing quality according to the type of print media can be obtained even when the user does not set the resolution.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A printing method according to a type of print media using an inkjet printer, which includes a wide printhead having a width longer than a width of the print media and disposed perpendicularly to a media conveying direction, the method comprising the steps of:

picking up the print medium and feeding the medium toward under the wide printhead;

determining a type of the fed medium; and printing on the medium in a predetermined resolution and in a predetermined ink dropping speed according to the determined type of the medium, wherein the determining of the type of the medium comprises:

detecting a characteristic value of the fed medium; and determining the type of the medium by comparing a characteristic value of the medium to values stored in a look-up table; and extracting the predetermined resolution and the predetermined ink dropping speed from the look-up table according to the type of medium;

wherein the characteristic value is an optical output value that is measured by an optical sensor by irradiating light onto the fed medium and receiving the light reflected from the medium; and wherein in the printing of the medium, vertical resolution is formed by controlling a feeding speed of the medium using a feeding roller driver, and horizontal resolution and the ink dropping speed are controlled using a printhead driver that controls nozzles of the printhead.

2. The method of claim 1, wherein the step of determining the type of the medium is performed by inputting the type of the medium that will be fed using a control panel or a host computer that provides printing data by a user.

3. An apparatus for printing on a print medium based on the type of print medium, comprising:

a printer controller for controlling the printing of an image on a medium;

a sensor for detecting a characteristic of a print medium on which an image is to be printed and sending a signal corresponding to the detected print medium characteristic to the printer controller;

a look-up table for storing characteristics of different types of print media;

a feeding roller driver for controlling the vertical resolution of the image to be printed on the print medium; and a printhead driver for controlling an ink dropping speed of a wide printhead having a width longer than a width of the print medium, and for controlling the horizontal resolution of the image to be printed on the print medium;

wherein the printer controller compares the signal corresponding to the detected print medium characteristic received from the sensor to the print media characteristics stored in the look-up table and outputs a signal based on the result of the comparison to the feeding roller driver and the printhead driver;

wherein the detected print medium characteristic is an optical output value that is measured by the sensor by irradiating light onto the print medium and receiving the light reflected from print medium; and wherein the print controller extracts the resolution and the ink dropping speed from the look-up table according to the type of medium.

4. The apparatus of claim 3, wherein the vertical resolution is controlled by the feeding speed of the print medium based on a signal received by the feeding roller driver from the printer controller.

5. The apparatus of claim 3, wherein the horizontal resolution and an ink dropping speed are controlled by the printhead driver that controls nozzles of the printhead based on a signal received from the printer controller.

* * * * *

UNITED STATES PATENT AND TRADEMARK OFFICE

CERTIFICATE OF CORRECTION

PATENT NO. : 7,581,799 B2
APPLICATION NO. : 11/171363
DATED : September 1, 2009
INVENTOR(S) : Im et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 357 days.

Signed and Sealed this

Fourteenth Day of September, 2010

David J. Kappos

David J. Kappos
*Director of the United States Patent and Trademark Office*